US006540621B1

(12) United States Patent
Robinson

(10) Patent No.: US 6,540,621 B1
(45) Date of Patent: Apr. 1, 2003

(54) GOLF GRIP TRAINING AID

(76) Inventor: Walter Robinson, 3 Eagle Nest Dr., Lincoln, RI (US) 02865

( * ) Notice: Subject to any disclaimer, the term of this patent is extended or adjusted under 35 U.S.C. 154(b) by 0 days.

(21) Appl. No.: 09/860,878

(22) Filed: May 18, 2001

(51) Int. Cl.[7] ..... A63B 69/36; A63B 53/14
(52) U.S. Cl. ..... 473/201; 473/206
(58) Field of Search ..... 473/201, 206, 473/202, 203, 204, 205, 300, 282, 226, 227

(56) References Cited

U.S. PATENT DOCUMENTS

| | | | | |
|---|---|---|---|---|
| 1,075,054 | A | * | 10/1913 | Morley |
| 1,556,473 | A | | 10/1925 | Ballou |
| 1,694,992 | A | | 12/1928 | Stoeffler |
| 1,822,212 | A | | 9/1931 | Griffiths |
| 1,997,364 | A | | 4/1935 | Holden et al. |
| 2,223,437 | A | | 12/1940 | Yeager, Jr. |
| 2,484,762 | A | | 10/1949 | Strazza |
| 2,710,190 | A | | 6/1955 | Schimansky |
| 2,928,678 | A | | 3/1960 | Cutting |
| 3,077,349 | A | | 2/1963 | Leonard |
| 3,111,322 | A | * | 11/1963 | English |
| 3,256,023 | A | | 6/1966 | Frazelle |
| 3,806,130 | A | | 4/1974 | Jacques |
| 4,252,319 | A | * | 2/1981 | Lorang |
| 4,361,326 | A | | 11/1982 | Kokes |
| 5,042,804 | A | * | 8/1991 | Uke et al. |
| 5,287,584 | A | * | 2/1994 | Skinner |
| 5,348,303 | A | * | 9/1994 | Swissheim |
| 5,377,984 | A | * | 1/1995 | Ciccia |
| 5,480,146 | A | * | 1/1996 | Comer |
| 5,954,591 | A | * | 9/1999 | Liberatore |
| D449,360 | S | * | 10/2001 | Kallassy |

* cited by examiner

*Primary Examiner*—Paul T. Sewell
*Assistant Examiner*—Nini F. Legesse
(74) *Attorney, Agent, or Firm*—Thomas L. Bohan; Patricia M. Mathers

(57) ABSTRACT

A device for properly positioning and constraining the grip of a golfer on a golf club handle and, particularly, for preventing the thumb from rotating to the right or to the left during the golf stroke.

3 Claims, 1 Drawing Sheet

GOLF GRIP TRAINING AID

BACKGROUND INFORMATION

1. Field of the Invention

The invention relates to the sport of golf. More particularly, this invention relates to a grip-training aid for golfers.

2. Description of the Prior Art

In the sport of golf, it is of critical importance that the golf club head be properly aligned at the instant of contact with the golf ball, that is, the bottom horizontal plane of the club head must be parallel to the ground so that the hitting face of the club head strikes the ball squarely with the correct angle on the hitting face to drive the ball in the desired trajectory. If the club is rotated so that the bottom horizontal plane of the club head is not parallel to the ground at the instant of impact, the swing will result in a slice or a hook, depending on the direction of rotation imposed on the club. In either case, the swing is a disappointment to the golfer because the ball does not travel the intended path.

In order to avoid hooks or slices, golfers learn to grip the handle of the golf club with a typical golfer grip that positions the hand of the "swing arm" or "prominent arm" on the club handle so that the club head is properly aligned through the swing. The prominent arm is the arm that provides the power in the golf stroke. For example, if a golfer is right-handed, the prominent arm is the left arm. The hand of the prominent arm is referred to hereinafter as the "prominent hand" and the hand of the other arm referred to as the "non-prominent" hand. The non-prominent hand and arm are used for stabilization, i.e., to help the golfer maintain his or balance through the swing-action, but should neither provide the power for the stroke, nor influence the direction or alignment of the club.

The typical "golfer grip" around the club handle is as follows: the index finger of the prominent hand is placed between the fourth and fifth fingers of the non-prominent hand, both palms curving around the club handle. The thumb of the prominent hand is centered on the front of the handle and points straight downward toward the club head, which is now properly aligned. This grip serves two purposes: to place the prominent hand such that the club head is correctly aligned for the swing, and also to prevent the non-prominent hand from gripping the handle tightly and providing the power for the swing. This golfer grip makes it impossible or at least unlikely that the fourth and fifth fingers of the non-prominent hand can grip the handle tightly and, thus, prevents the non-prominent arm from controlling the power and direction of the club during the swing action. Inexperienced golfers will occasionally try to grip the handle of the golf club in a manner similar to a "baseball bat" grip. In other words, both hands grip the club tightly, with the index finger of the upper hand on the handle touching the little finger of the lower hand. This grip is mightily discouraged by experienced golfers as it distorts the desired dynamics of the golf swing.

The difficulty for golfers is two-fold: aligning the thumb of the prominent hand properly and keeping the non-prominent arm from providing power and direction to the swing-action. Most golf clubs have an insignia or some mark printed on the front of the handle, so that, if the golfer places his or her thumb of the prominent hand in alignment with the insignia, the thumb is correctly centered on the handle. Assuming that the golfer has the proper hand placement and is using the proper grip, it is still possible for the thumb of the prominent arm to rotate out of position in the course of the swing, thereby negatively influencing the accuracy of the swing, and often resulting in a sliced or hooked ball, depending on whether the thumb was rotated to the right or to the left.

Many attempts have been made to improve the golfer's grip on the handle and aids have been developed that help the golfer place his or her thumb in the proper position, and/or maintain a loose grip of the non-prominent hand on the handle. The disadvantages of many of the known training devices are that, though they position the thumb of the prominent hand properly, they do not prevent it from rotating or sliding down on the handle. Other devices prevent the non-prominent hand from gripping the handle tightly, but again, do not prevent the thumb of the prominent hand from rotating out of position and causing a hook or a slice. Holden et al (U.S. Pat. No. 1,997,364; 1935) teaches a device that is permanently mounted on a golf club handle and that prevents the thumb from moving down on the handle. The disadvantage of the Holden et al. device is that the sides of the intermediate portion that holds the thumb taper down toward the club handle before the first knuckle of the thumb, and, therefore, do not prevent the thumb from rotating to the right or to the left. The Holden et al. device also does not prevent the fourth and fifth fingers of the non-prominent hand from gripping the golf club handle tightly because the device is relatively flat toward the front and rises up just around the edge of the thumb, thereby making it possible for one to grip the handle tightly with all fingers of the non-prominent hand.

Stoeffler (U.S. Pat. No. 1,694,995; 1928) teaches a grip aid that is permanently attached to the handle of the golf club. That device provides a single wing-like formation that helps to position the thumb of the lower, i.e., non-prominent, hand and to keep it from rotating to the right. The disadvantages of the Stoeffler device, however, are that it does not aid in positioning and controlling the rotation of the thumb of the prominent hand, nor does it prevent the prominent hand from sliding down on the handle. Both the Holden et al. and Stoeffler devices are permanently affixed to the golf club handle. This may be disadvantageous in that, if and when the golf clubs are used by another person, the device may not be properly positioned for that person.

What is needed, therefore, is a device that aids in positioning the thumb of the prominent hand correctly on the golf club handle. What is further needed is such a device that prevents the thumb of the prominent hand from rotating to the right or to the left. What is yet further needed, is such a device that prevents the non-prominent hand from tightly gripping the handle of the golf club. And finally, what is needed is a device that can be removably yet securely mounted on the handle of any conventional golf club.

BRIEF SUMMARY OF THE INVENTION

For the above-cited reasons, it is an object of the present invention to provide a device that aids the golfer in placing the thumb of the prominent hand in the proper position on the handle of the golf club. It is a further object to provide such a device that will prevent the thumb of the prominent hand from rotating to the right and to the left. It is a yet further object of the invention to provide such a device that will prevent the golfer from tightly gripping the golf club handle with the non-prominent hand. It is a still yet further object of the invention to provide such a device that is removably yet securely mountable on the handle of a golf club.

The objects are achieved by providing a thumb-positioning device that is removably mountable on the handle of a golf club, is positionable at a particular spot on the handle, and that cradles the thumb of the swing-arm in such a manner that the thumb is centered properly on the handle grip and held in such a way that it cannot rotate out of position. Furthermore, the device of the present invention prevents several fingers of the non-prominent hand from tightly gripping the club handle, even if the "baseball bat" grip is used.

The heart of the present invention is a thumb cradle that is removably positionable on the club handle such that there is sufficient force on the handle to hold it in position through a swing or a stroke. The face of the cradle, i.e., the part of the cradle that is intended to face upward from the front of the handle of the golf club, has a U-shaped contour. As the term "cradle" implies, the device of the present invention has cradle or side walls. These cradle walls rise upward away from the handle so as to form the cradle in which to position and restrain the thumb from rotating to the left or to the right. The cradle walls also prevent the fourth and fifth fingers of the non-prominent hand from gripping the golf dub handle tightly, even if the so-called baseball bat grip is used.

The present invention can be provided in a number of embodiments: as a single-piece construction that includes the cradle and a means of mounting the cradle on the golf club handle, or as a hinged or multiple-piece device that snaps or closes around the handle. For example, the cradle can be attached to a fastening means for removably mounting it to the golf club handle, such as a fabric hook-and-loop type fastener that would allow the device to be removed quickly and easily from the handle. Also, any number of different materials may be used to construct the device of the present invention: for example, plastic materials, metals, rubber, or other materials that provide the rigidity of form to properly restrain the thumb from rotation and the ability to be securely fastened to the golf club handle.

DETAILED DESCRIPTION OF THE PREFERRED EMBODIMENT OF THE INVENTION

Figure 1:
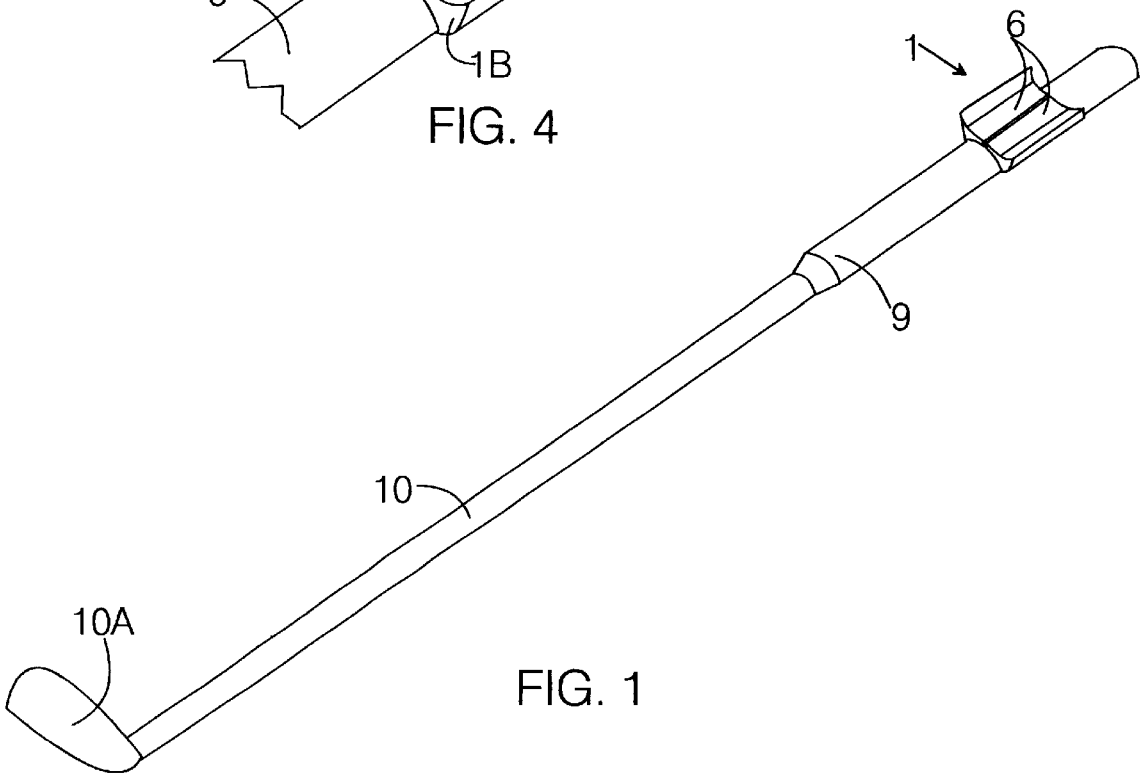
FIG. 1 illustrates the Preferred Embodiment of the device according to the invention, mounted on a conventional golf club.

FIG. 1 shows a conventional golf club 10 having a club handle 9. Removably mounted on the club handle 9 is a thumb device 1 according to the present invention. As can be seen in the FIGS. 1–4, the Preferred Embodiment of the thumb device 1 includes a cradle mount 5, which is a split ring with a split 5A, and a cradle 6 formed by cradle walls 3 and a base 3B. Each of the cradle walls 3 has an inner surface 3A, an outer surface 3C, and an upper edge 3U.

Figure 2:
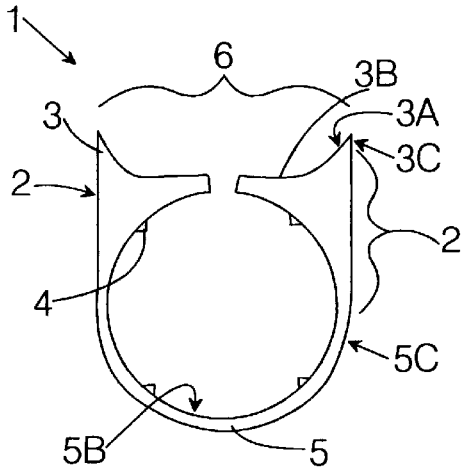
FIG. 2 is a front elevational view of the device shown in FIG. 1.
Figure 3:
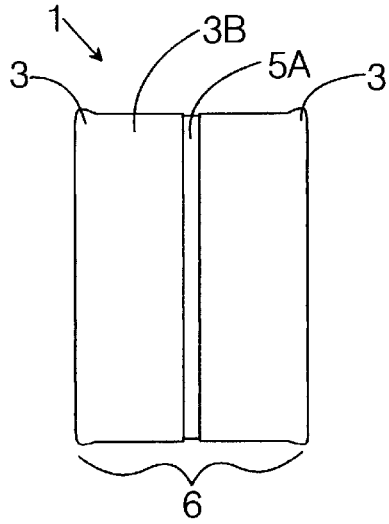
FIG. 3 is plan view of the device shown in FIG. 1.

The material of the Preferred Embodiment is a resilient, slightly flexible ZEPHLON nylon that is form-rigid, yet has sufficient flexibility to allow the split 6A to be forced apart by pressing the cradle walls 3 outward. The device 1 can then snap over the shank of the club 10 and be slid up to fit snugly over the club handle 9 when the cradle walls 3 snap back to their original form. The ring 5 has an inner surface 5B that may be tapered slightly to correspond to the taper of the conventional golf club handle. A plurality of ridges 4, shown in FIG. 2, are arranged on the inner surface 5B and grip into the handle 9, which, on a conventional golf club is padded, and prevent the device 1 from slipping vertically or radially about the handle 9 during the golfer's stroke.

Figure 4:
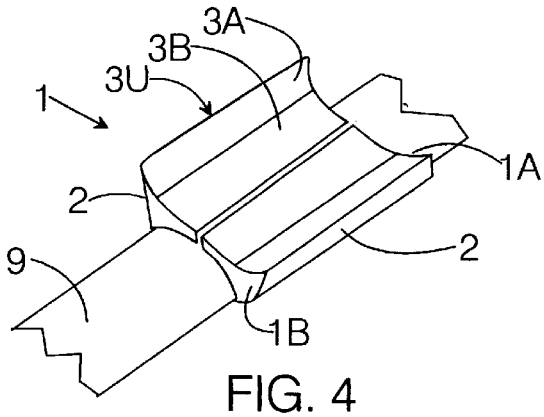
FIG. 4 is a perspective view of the device shown in FIG. 1.

As shown in FIGS. 1 and 4, the device 1 is properly placed on the handle 9 so that the cradle 6 faces upward from the handle 9 and provides a cradle-like support for the thumb of the prominent hand when the club 10 is held such that the hitting face 10A of the club 10 is in the proper hitting position at the instant of contact with the ball.

The Preferred Embodiment of the device 1 according to the invention is formed as a single piece having a first end 1A, a second end 1B. The cradle walls 3 are integrally formed with the cradle mount 5, which has an outer contour 5C that extends upward smoothly on either side the crade 6 until it meets with the outer surfaces 3C of the cradle walls 3 and forms a smooth barrier wall 2 on each outer side of the cradle 6. The golfer grips the club 10 with both hands, the thumb of the prominent hand fitting into the cradle 6. Using the golfer's grip, whereby the index finger of the prominent hand is inserted between the fourth and fifth fingers of the non-swing hand, the golfer grips the handle tightly with the prominent hand, while gripping only lightly with the non-prominent hand. The cradle 6 prevents the thumb from rotating to the left, which would cause a hook swing, or to the right, which would cause a slice swing. Furthermore, the barrier walls 2 are high enough to prevent several fingers of the non-prominent hand from gripping the handle 9 tightly and influencing the direction of the swing. Even if a golfer uses the so-called "baseball bat" grip, with the two hands touching each other on the handle 9, the barrier walls 2 will prevent the fourth and fifth fingers of the non-prominent hand from closing around the handle 9.

As mentioned above, the Preferred Embodiment of the device 1 according to the invention is made of a ZEPHLON-nylon material. It is well within the scope of the invention, however, that the device 1 be made of any material that provides the necessary form-rigidity. Further, the Preferred Embodiment is constructed as a single piece that is a split ring.

The device 1 of the present invention can be provided as a single exemplar that is removable from one club 10 and placeable on another one as the golfer chooses different clubs for the particular task at hand, or can be provided as a set of thumb devices that includes one device for each club in a set of golf clubs.

While a Preferred Embodiment is disclosed herein, this is not intended to be limiting. Rather, the general principles set forth herein are considered to be merely illustrative of the scope of the present invention and it is to be further understood that numerous changes may be made without straying from the scope of the present invention.

What is claimed is:

1. A device for constraining the grip of a golfer on a golf club, said golf club having a golf club handle and a club head, said device comprising:

a cradle formed by a base and a first cradle wall and a second cradle wall;

a cradle mount; and a first end that includes a first cradle end and a first cradle mount end, and a second end that includes a second cradle end and a second cradle mount end;

wherein said first cradle wall and said second cradle wall rise upwardly from said base and said first cradle end and said second cradle end remain open so as to form a substantially U-shaped open-ended cradle;

wherein said first cradle wall and said second cradle wall each have an outer surface and an inner surface and an upper edge and said upper edge extends from said first end to said second end substantially parallel to said base;

wherein said cradle mount has an inner contour in which said golf club handle is receivable and an outer contour that is integrally formed with said outer surface of said first cradle wall and said second cradle wall so as to form a substantially flat barrier wall that rises on each side of said cradle from said cradle mount to said upper edge; and wherein said cradle mount is slidably mountable on said golf club handle.

2. The device of claim 1, wherein said golf club handle has an orientation, an upper end of said golf club handle, when grasped for a golf swing, being oriented toward said golfer and a lower end of said golf club handle being oriented toward said club head, and wherein said device is symmetrical in form with regard to said first end and said second end and is mountable on said golf club handle with said first end oriented toward said upper end of said golf club handle or toward said lower end.

3. The device of claim 1, wherein said cradle mount and said base are integrally formed and said cradle mount is a split, ring having a split in said base that extends parallel to and between said first cradle wall and said second cradle well and from said first end to said second end, and wherein said inner contour of said split ring has one or more ridges that extend inward from said inner contour toward a center of said split ring for gripping into said handle.

* * * * *